United States Patent [19]

Hertweck et al.

[11] Patent Number: 4,697,569

[45] Date of Patent: Oct. 6, 1987

[54] INTAKE SYSTEM FOR A MULTI-CYLINDER INTERNAL COMBUSTION ENGINE

[75] Inventors: Gernot Hertweck, Fellbach; Fritz Kappis, Sulzbach; Guenter Kellermann, Stuttgart; Klaus Schalueck, Schwaikheim, all of Fed. Rep. of Germany

[73] Assignee: Daimler-Benz Aktiengesellschaft, Stuttgart, Fed. Rep. of Germany

[21] Appl. No.: 865,429

[22] Filed: May 21, 1986

[30] Foreign Application Priority Data

May 23, 1985 [DE] Fed. Rep. of Germany ..... 3518505

[51] Int. Cl.[4] ..... F02M 25/06

[52] U.S. Cl. ..... 123/568

[58] Field of Search ..... 123/568, 569, 198 F

[56] References Cited

U.S. PATENT DOCUMENTS 4,192,278 3/1980 Iizuka et al. ..... 123/568 X
4,201,180 5/1980 Iizuka ..... 123/568 X
4,345,571 8/1982 Iizuka et al. ..... 123/568
4,409,936 10/1983 Dozono ..... 123/198 F
4,445,487 5/1984 Higashi ..... 123/568
4,466,416 8/1984 Kawamura ..... 123/569 X

*Primary Examiner*—Willis R. Wolfe, Jr.
*Attorney, Agent, or Firm*—Barnes & Thornburg

[57] ABSTRACT

This invention relates to an intake system for a multi-cylinder internal-combustion engine operating with exhaust gas recirculation and fuel injection, having an air-guiding casing that is developed in the shape of a box and has a partition that, on the one side, is the wall part for a clean-air side and, on the other side, is a wall part for a mixing duct and a distributor volume that has connecting points for suction pipes of the internal-combustion engine. In the partition, an air-throttle valve is disposed centrally that controls the air inlet into the mixing duct, and downstream of the valve and concentrically to it, the inlet for recirculated exhaust gas is arranged. Passages that extend in an arched course and are located symmetrically with respect to the position of the air-throttle valve connect the mixing duct with the distributor volume.

11 Claims, 3 Drawing Figures

INTAKE SYSTEM FOR A MULTI-CYLINDER INTERNAL COMBUSTION ENGINE

BACKGROUND AND SUMMARY OF THE INVENTION

This invention relates to an intake system for a multi-cylinder internal-combustion engine operating with exhaust-gas recirculation and fuel injection, particularly an air-compressing injection internal-combustion engine having an air-guiding casing for guiding or mixing clean air and recirculated exhaust gases to be supplied to the engine intake connections.

It has been contemplated to provide that, in order to achieve a better exhaust gas quality, recirculated exhaust gas is furnished to the combustion air flow in certain load ranges of the multi-cylinder internal-combustion engine. In the case of the intake system according to German Pat. No. (DE-PS) 3 324 343, corresponding to commonly assigned co-pending U.S. patent application Ser. No. 627,666, filed July 3, 1984, now U.S. Pat. No. 4,640,256, a mixing duct that is separated from the distributor volume is provided in a compactly constructed air-guiding casing, the mixing path of said mixing duct, in the case of the exhaust gas recirculation, having the purpose of causing a good mixing of the furnished exhaust gases with the combustion air before the entering of same into the distributor volume space.

This invention is based on the objective of developing a compactly constructed air-guiding casing of the above-mentioned type by means of simple constructional measures on the inside of the casing to the extent that a better mixing of the exhaust gas with the combustion air and subsequently a more even distribution of the air-exhaust gas mixture at the individual cylinders of the internal-combustion engine can be achieved.

The objective according to the invention is achieved by providing a throttle valve disposed centrally of the mixing duct means for communicating clean air to the mixing duct, with exhaust gas supply surrounding the throttle valve.

By means of the measures according to especially preferred embodiments of the invention, in the case of the exhaust-gas recirculating operation, because of the special position of the exhaust gas inlet into the mixing duct as well as by means of the special assignment of this inlet in the direction of the air inlet, an optimal mixing of the exhaust gases with the combustion air is achieved. In addition, by means of the special arrangement of the air throttle valve in the wall part of the partition as well as by means of the air-exhaust gas transfer points that are arranged symmetrically between the mixing duct and the distributor volume, a more even distribution of the mixture on the individual cylinders is achieved while maintaining a high volumetric efficiency. The exhaust gas quality of multi-cylinder internal-combustion engines is improved in this way.

In the case of the air-guiding casing according to DE-PS No. 3 324 343, there is an orientation in the mixing duct of the exhaust gas inlet to the air inlet, said orientation, in order to achieve an almost homogeneous air-exhaust gas mixture, requiring a long mixing path. As a result, locally unfavorable overflow cross-sections occur from the mixing duct to the distributor volume because of which an even distribution of the mixture on the individual cylinders cannot be achieved to the desirable extent.

Further objects, features, and advantages of the present invention will become more apparent from the following description when taken with the accompanying drawings which show, for purposes of illustration only, an embodiment/several embodiments in accordance with the present invention.

DETAILED DESCRIPTION OF THE DRAWINGS

Figure 1:
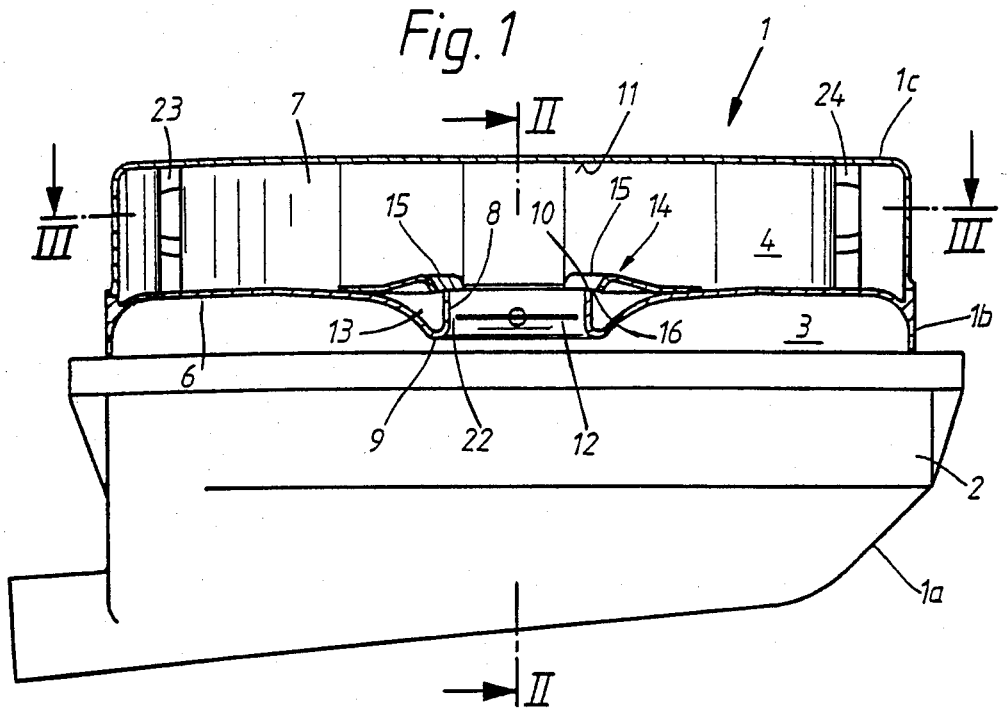
FIG. 1 is a partial sectional view of a compactly designed air-guiding casing system constructed in accordance with a preferred embodiment of the invention.

The intake system of a multi-cylinder internal-combustion engine having fuel injection and exhaust-gas recirculation contains a three-part air-guiding casing 1 (FIGS. 1 and 2) that is constructed like a box. The lower casing part 1*a* of casing 1 is formed as a lid and has an air filter 2. The center casing part 1*b* of casing 1 has a clean-air side 3 downstream of the air filter 2. The upper housing part 1*c* of casing 1 is provided with a mixing duct 4 and a distributor volume space 5.

Figure 3:
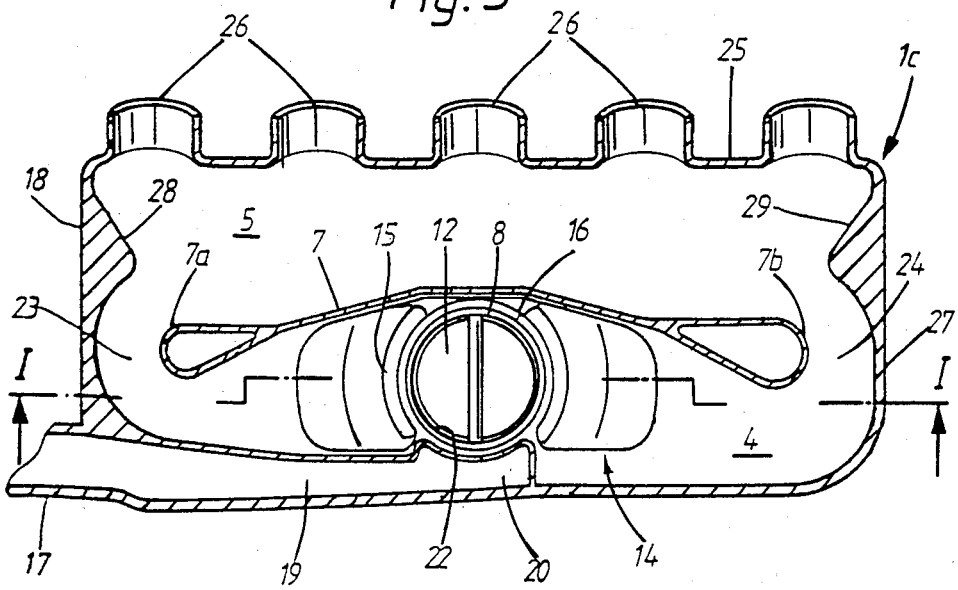
FIG. 3 is a partial sectional view of the air-guiding casing taken along Line III—III in FIG. 1.
Figure 2:
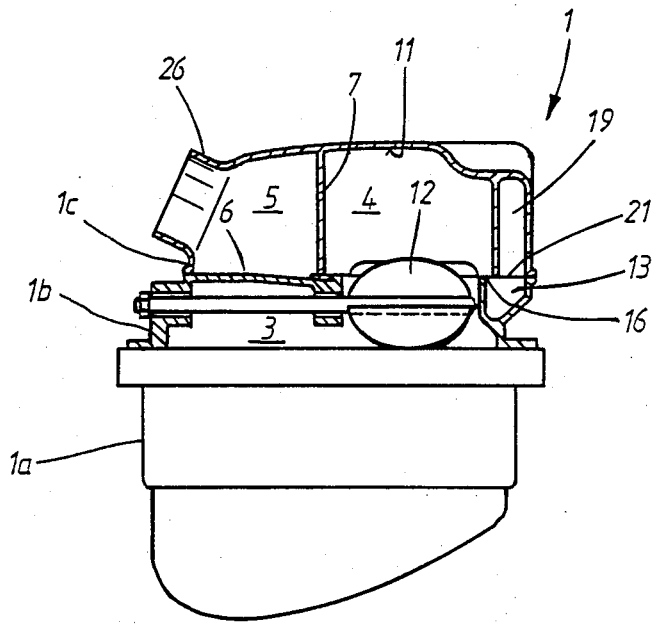
FIG. 2 is a partial sectional view of the air-guiding casing system taken along Line II—II in FIG. 1.

The center housing part 1*b* has the shape of a boat and its bottom part 6, in the mounted air-guiding casing 1, serves as a separating wall or partition that, on the one side, is the wall part for the clean-air side 3 and, on the other side, is the wall part for the mixing duct 4 located on the right according to FIG. 2 and the distributor volume space 5 located on the left next to it. The mixing duct 4 and the distributor volume space 5 are separated from one another by means of a mixing duct wall 7 (FIGS. 2, 3).

In its central area, the partition 6 is shaped into a connection piece 8. The edge 9 of connection piece 8 on the inlet side is rounded off and merges into a sleeve shaped projection into the clean-air side 3. The edge 10 of connection piece 8 on the outlet side is flush with the partition 6. The connection piece 8 is aimed at a right angle toward the opposite bottom 11 of the upper casing part 1*c*. An air throttle valve 12 is pivotally supported in the connection piece 8.

A ring duct 13 for the exhaust gas is formed by the deformation at edge 9, which duct 13 is covered by means of a ring-shaped covering body 14 fastened at the partition 6. The covering body 14 is provided with flow-efficient shaped-on parts 15 and is arranged concentrically to the connection piece 8 in such a way that a small ring gap 16 remains for the passage of the exhaust gas.

An exhaust-gas recirculating duct 19 originating from the connecting point 17 of the side wall 18 is cast into the upper housing part 1*c* and ends at point 20 at half the length of the longitudinally extending housing part 1*c*. From this point 20, the recirculated exhaust gas arrives via the overflow cross-section 21 (FIG. 2) in the ring duct 13, is guided around the connection piece 8 and finally flows through the exhaust-gas ring gap 16 into the mixing duct 4 and mixes there with the combustion air flowing in via an air ring gap 22 formed by the closed air throttle valve 12 (FIG. 1) and the connection piece 8. The air-exhaust gas mixture flow divides and the partial flows of the homogeneous air-exhaust gas mixture reach the distributor volume space 5 adjacent to the mixing duct 4 via arched passages 23, 24 that are arranged sysmmetrically with respect to the air throttle valve 12. The longitudinal wall 25 of the upper housing part 1*c* of distributor volume space 5 is opposite the mixing duct wall 7 and has connecting points 26 for the suction pipes leading to the internal-combustion engine.

The passages 23, 24 are formed by waterdrop-shaped end areas *7a*, *7b* of the mixing duct wall 7 and by molded on or integrally formed parts 28, 29 of the side walls 18, 27.

By means of the special development of the air-guiding casing 1, an optimal mixing of the air and the exhaust gas is achieved as well as a more even distribution of the air-exhaust gas mixture in the distributor volume space 5. The air-guiding casing 1 is suitable also for internal-combustion engines with a higher and lower number of cylinders.

When the engine is operating and in the partial-load range, when the exhaust gas is recirculated, the air throttle valve 12 is closed completely (FIG. 1). For the reduction of the exhaust-gas recirculating rate in the high partial-load range, the air throttle valve is partially opened (FIG. 2). During the full-load operation, the air-throttle valve is completely opened, but the exhaust-gas recirculating valve that is not shown is closed completely.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. An intake system for a multi-cylinder internal combustion engine of the type operating with exhaust gas recirculation, comprising:

clean air chamber means for transmitting clean air, recirculating exhaust gas supply means for transmitting engine exhaust gases, mixing duct means for accommodating mixing of clean air from the clean air chamber means with recirculated exhaust gases from the exhaust gas supply means, distributor space means disposed downstream of the mixing duct means and including connection points for suction intake pipes of an internal combustion engine, and movable air throttle means interposed between the clean air chamber means and the mixing duct means for variably controlling the flow of air from the clean air chamber means to the mixing duct means, and thereby optimize the mix of said clean air to said recirculated exhaust gases in said mixing duct means, wherein the partition wall means is disposed between the clean air chamber means and the mixing duct means and distributor space means, wherein the air throttle valve means is arranged centrally of the mixing duct means in the partition wall means, and wherein the exhaust gas supply means opens downstream of and concentrically to the throttle valve means.

2. A system according to claim 1, wherein said engine is an air compressing injection internal combustion engine.

3. A system according to claim 1, wherein a mixing duct wall means separates the mixing duct means and distributor space means, said mixing duct wall means delimiting passage means between the mixing duct means and the distributor space means, wherein said passage means extend in an arched course and are arranged symmetrically with respect to the air throttle valve means.

4. A system according to claim 3, wherein air guide casing means surround and at least partially delimit the mixing duct means and distributor space means.

5. A system according to claim 4, wherein the passage means that entered in an arched course are formed by drop-shaped end areas of the mixing duct wall means and integrally formed parts of side walls of the casing means.

6. A system according to claim 3, wherein said air throttle valve means includes a pivotally mounted throttle flap.

7. A system according to claim 6, wherein the wall part of the partition wall means that delimits the mixing duct is formed to be essentially flat and is formed in the area of the throttle valve means into a connection piece which is the bearing point for the throttle flap.

8. A system according to claim 7, wherein the connection piece, together with a covering body fastened at the partition wall means, forms an exhaust-gas ring duct connected with an exhaust-gas pipe of the exhaust gas supply means, and wherein the connection piece is surrounded by the covering body in such a way that an exhaust-gas ring gap is formed.

9. A system according to claim 8, wherein the exhaust-gas ring gap is located at the end of the connection piece on the outlet side.

10. A system according to claim 7, wherein the exhaust-gas pipe that is formed as an exhaust-gas duct is cast into an upper casing part of an air-guiding casing, said exhaust-gas pipe, originating from a side wall of the casing, extending in parallel to the mixing duct means and leading to the exhaust-gas ring duct in the adjacent central casing part.

11. A system according to claim 10, wherein the passage means that extend in an arched course are formed by drop-shaped end areas of the mixing duct wall means and shaped-on parts of the side walls of the casing part.

* * * * *